United States Patent [19]

Satake

[11] Patent Number: 4,625,871

[45] Date of Patent: Dec. 2, 1986

[54] AUTOMATIC BACKGROUND BRIGHTNESS CONTROL DEVICE FOR COLOR SORTING APPARATUS

[75] Inventor: Toshihiko Satake, Higashihiroshima, Japan

[73] Assignee: Satake Engineering Co., Ltd., Tokyo, Japan

[21] Appl. No.: 545,244

[22] Filed: Oct. 25, 1983

[30] Foreign Application Priority Data

Dec. 25, 1982 [JP] Japan ..... 57-226501

[51] Int. Cl.[4] ..... B07C 5/342

[52] U.S. Cl. ..... 209/549; 209/581

[58] Field of Search ..... 209/546, 548, 549, 576, 209/580-582, 587, 551; 250/205

[56] References Cited

U.S. PATENT DOCUMENTS

| | | | |
|---|---|---|---|
| 2,823,301 | 2/1958 | Stevens | 250/205 |
| 3,215,843 | 11/1965 | Neil | 250/205 |
| 3,373,870 | 3/1968 | Black et al. | 209/582 X |
| 3,738,484 | 6/1973 | Hoover et al. | 209/581 |
| 4,088,227 | 5/1978 | Lockett | 209/581 |
| 4,097,732 | 6/1978 | Krause et al. | 250/205 |
| 4,249,648 | 2/1981 | Meyer | 194/102 |
| 4,252,240 | 2/1981 | Satake | 209/580 |
| 4,323,159 | 4/1982 | Wolf | 209/548 X |

FOREIGN PATENT DOCUMENTS 2091415 7/1982 United Kingdom ..... 209/576

*Primary Examiner*—Robert B. Reeves
*Assistant Examiner*—Edward M. Wacyra
*Attorney, Agent, or Firm*—Wegner & Bretschneider

[57] ABSTRACT

The invention relates to an automatic background brightness control device for color sorting apparatus having a plurality of sorting channels (Q1–Qn), each including a sensor (S1–Sn) to detect the amount of reflected and/or transmitted light from objects to be sorted and the amount of reflected and/or transmitted light from a background provided at the sorting channel. A scanner circuit (12, 14, 16) selects from the sorting channels one sorting channel of which the background brightness is to be controlled. A process control circuit (11) is provided to compare the output from the sensor against predetermined reference voltages and to produce a signal for controlling the background brightness only when the output from the sensor deviates from the reference voltages. A light control circuit (P1–Pn) controls the background brightness within the selected sorting channel according to the signal for controlling the background brightness.

6 Claims, 5 Drawing Figures

AUTOMATIC BACKGROUND BRIGHTNESS CONTROL DEVICE FOR COLOR SORTING APPARATUS

BACKGROUND OF THE INVENTION

The present invention relates to an improvement in a colour sorting apparatus for sorting objects such as grains according to their colours, and more particularly, to a control device for automatically controlling a background brightness thereof.

A colour sorting apparatus is so arranged that the amount of reflected and/or transmitted light from grains of a usual colour passing through a sorting area and the amount of reflected and/or transmitted light from the background thereof are made to be identical to each other and are detected by means of a sensor consisting of such means as a photo-sensitive element, and for sorting grains, the sensor detects the variation in the amount of light which occurs at the time when a grain with a colour different from the usual colour passes the sorting area and an ejector blows away the grain with a colour different from the usual colour on the basis of the signal detected by the sensor. When this colour sorting apparatus is continuously operated for a long period of time, the background becomes dusty so that a disagreement develops between the amount of reflected and/or transmitted light from the grains and the amount of reflected and/or transmitted light from the background, thereby making it impossible to carry out the desired sorting operation. Thus, in a conventional apparatus, the signal from the sensor is displayed on an oscilloscope and the background brightness is manually controlled in order to achieve the desired sorting performance. However, such manual control of background brightness required for the conventional apparatus involves troublesome and time-consuming work, in particular, for the conventional apparatus which is provided with a large number of sorting channels.

SUMMARY OF THE INVENTION

It is, therefore, a primary object of the present invention to provide an automatic control device for use in a colour sorting apparatus which is capable of automatically controlling the background brightness which has been manually controlled in a conventional apparatus.

In accordance with the present invention, there is provided an automatic background brightness control device for a colour sorting apparatus having a plurality of sorting channels, each of the channels including a sensor for detecting the amount of reflected and/or transmitted light from objects to be sorted and the amount of reflected and/or transmitted light from a background provided at the sorting channel, the device comprising: a scanner circuit means for selecting from the sorting channels one sorting channel of which the background brightness is to be controlled; a process control means for comparing the output from the sensor against predetermined reference voltages and producing a signal for controlling the background brightness only when the output from the sensor deviates from the reference voltages; and a light control means for controlling the background brightness within the selected sorting channel according to the signal for controlling the background brightness.

In accordance with the present invention, there is also provided an automatic background brightness control device for a colour sorting apparatus having a plurality of sorting channels, each of the channels including a sensor, an ejector driver circuit and a feeder, the sensor being adapted to detect the amount of reflected and/or transmitted light from objects to be sorted and the amount of reflected and/or transmitted light from a background provided at the sorting channel, the device comprising: a scanner circuit means for selecting from the sorting channels one sorting channel of which the background brightness is to be controlled; a process control means including a means for comparing the number of times of pulses sent from the ejector driver circuit within a predetermined period of time against a reference number and producing a signal for controlling the operation of the feeder, and a means for comparing the output from the sensor against predetermined reference voltages and producing a signal for controlling the background brightness only when the output from the sensor deviates from the reference voltages; and a light control means for controlling the background brightness within the selected sorting channel according to the signal for controlling the background brightness.

BRIEF DESCRIPTION OF THE DRAWINGS

This invention will be more fully understood from the following detailed description of a preferred embodiment thereof, taken in connection with the accompanying drawings, in which.

DESCRIPTION OF THE PREFERRED EMBODIMENTS

Hereunder will be explained an example of the present invention by referring to the accompanying drawings.

Figure 1:
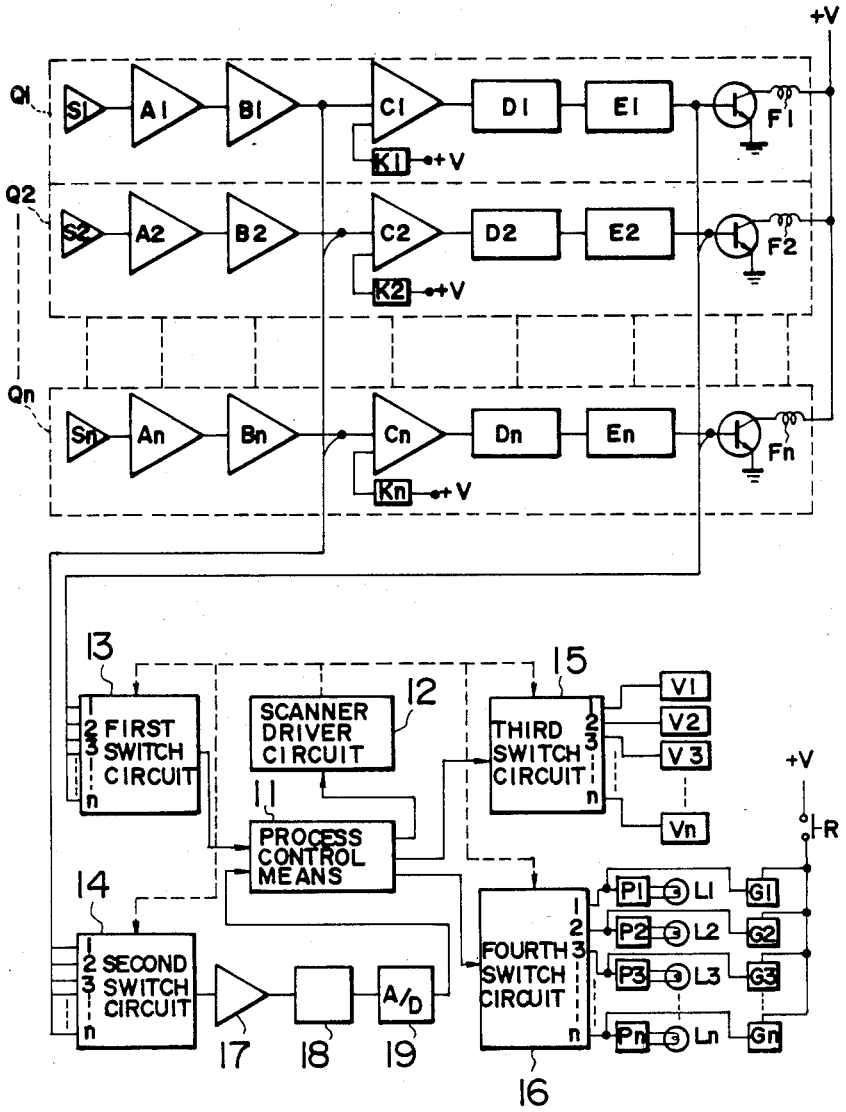
FIG. 1 is a block diagram of one preferred embodiment incorporating the device of the present invention.

Referring first to FIG. 1 which shows a diagrammatic representation of a colour sorting apparatus embodying the automatic control device of the present invention, the references Q1–Qn represent a plurality of sorting channels which all have an identical construction and are disposed within the colour sorting apparatus. Namely, the respective sorting channels Q1–Qn comprise corresponding light-sensitive sensors S1–Sn for detecting the amount of reflected and/or transmitted light from the background and the amount of reflected and/or transmitted light from the objects to be sorted such as grains; pre-amplifiers A1–An for amplifying the outputs detected by the sensors S1–Sn; main amplifiers B1–Bn for further amplifying the outputs from the above pre-amplifiers; comparators C1–Cn for comparing the outputs sent from the main amplifiers B1–Bn against the reference outputs set by means of level-setters K1–Kn and producing outputs at the passage of grains with a colour different from a reference colour (hereinafter referred to as substandard grains); and ejector means in which delay circuits D1–Dn delay the output signals from the comparators C1–Cn for driving ejector driver circuits E1–En which in turn activate electromagnetic valves F1–Fn of the ejectors, the ejector means removing the substandard grains with compressed air from the ejectors when the substandard grains pass in front of the ejectors.

The respective outputs of the driver circuits E1–En within the above sorting channels Q1–Qn are introduced to respective corresponding input terminals of a first switching circuit 13 of a scanner circuit means. And, the respective outputs of the main amplifiers B1–Bn are introduced in the same manner to respective corresponding input terminals of a second switching circuit 14 of the scanner circuit means. The output of the above first switching circuit 13 is input to a process control means 11 which includes a comparing means for comparing the level of output from an A/D converter 19 against reference voltages or includes this comparing means and a comparing means for comparing the number of output pulses from the first switching circuit 13 against a predetermined number. The process control means 11 can be generally realized by a microprocessor. And, the output of the second switching circuit 14 is also input to the process control means 11 through a series circuit of an amplifier 17, a wave processing circuit 18 and the A/D converter 19. The outputs of this process control means 11 are delivered to a scanner driver circuit 12, a third switching circuit 15 and a fourth switching circuit 16 of the scanner circuit means. The respective outputs of the above third switching circuit 15 are respectively sent to feeders V1–Vn of the respective channels which feeders are adapted to cause the grains to be fed to the respective sorting areas, and the respective output terminals of the above fourth switching circuit 16 are connected to a light control means, namely, to respective light control devices P1–Pn each of which operates to control the amount of light from respective light source lamps L1–Ln arranged at the back of the backgrounds of the respective sorting channels. Further, in this illustrated embodiment, display devices G1–Gn constituting an indicator means are also connected to the respective output terminals of the above fourth switching circuit 16. The reference symbol R represents a reset switch for resetting the display devices G1–Gn.

Next, the manner of operation of the embodiment which is constructed as stated above will be explained below.

Figure 2A:
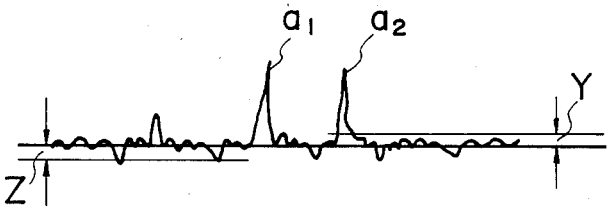
FIGS. 2*a*–2*c* show explanatory graphs showing general operation of the embodiment in accordance with the present invention.
Figure 2B:
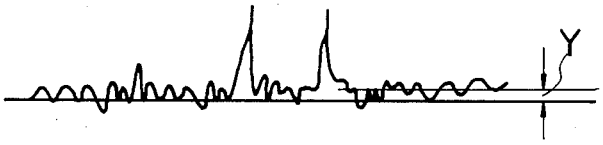
Figure 2C:
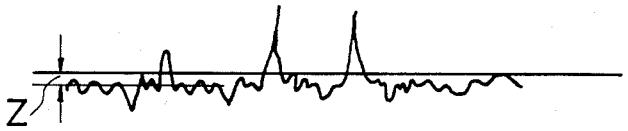

FIG. 2 gives explanatory graphs and there are shown some examples of output waveforms, under three different conditions, of the main amplifiers B1–Bn of the respective sorting channels to assist in understanding the operation of the embodiment. First of all, FIG. *2a* shows the output waveform under the normal operating condition where the amount of reflected and/or transmitted light from the grains with a usual colour and the amount of reflected and/or transmitted light from the background are made to be identical to each other. Such output waveform as shown in FIG. *2a* is compared at the comparators C1–Cn against comparison voltages established by the setters K1–Kn, and since the pulses a1 and a2 being produced based on the amount of reflected and/or transmitted light from grains with a substandard colour will exceed the above comparison voltages, the comparators C1–Cn produce outputs and the ejectors blow away such substandard grains, thus achieving the sorting operation as explained hereinabove. However, when a background is too bright, the waveform may take a form as shown in FIG. *2b* and there is a possibility that even some of the acceptable grains may be rejected as substandard grains. To the contrary, when a background is too dark, the output waveform may take a form as shown in FIG. *2c* and there is a possibility that some of the substandard grains may be accepted as good grains, thus leading to a deterioration of the sorting performance.

In a conventional colour sorting apparatus, in order to prevent the apparatus from falling into such an undesirable state as explained with reference to FIG. *2b* and FIG. *2c* which is caused by the background becoming either too bright or too dark for some reason, it is necessary to make a manual adjustment to attain an appropriate background brightness.

Therefore, according to the present invention, the signals from the sensors S1–Sn of the respective channels Q1–Qn are taken out one after another and on the basis of these respective signals the setting of the amount of the appropriate background light is automatically controlled.

Figure 3:
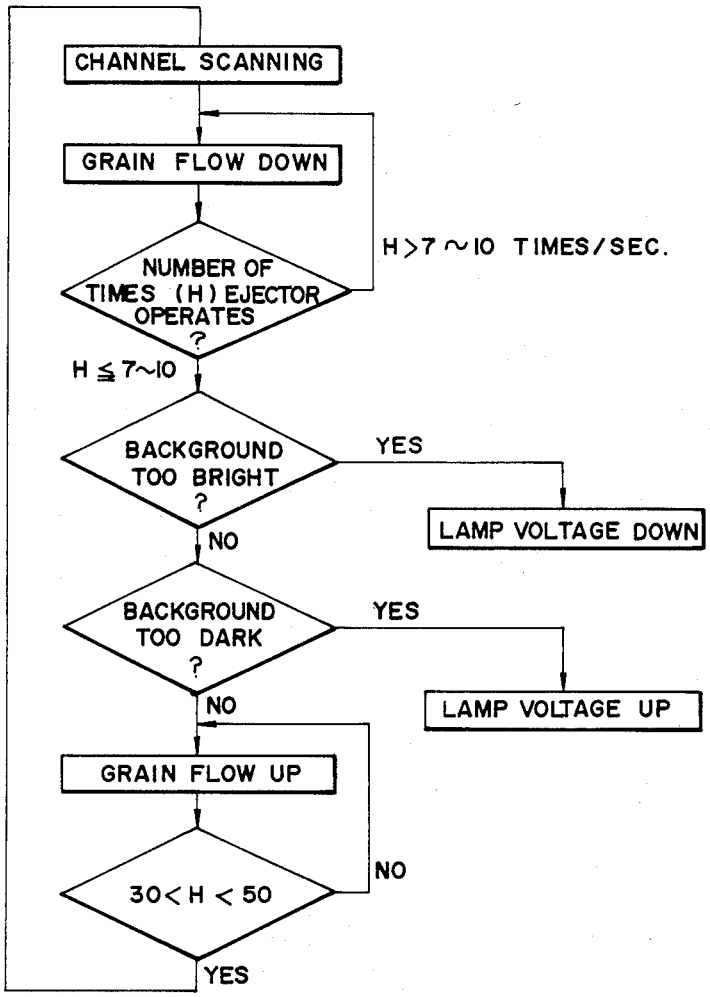
FIG. 3 is a flow diagram showing one cycle of the automatic control operation of the device of the present invention.

FIG. 3 is a flow diagram illustrating the procedure of the automatic control of background brightness. Hereinafter will be explained the manner of actual operation of the device of the present invention with reference to FIG. 3 as well as FIG. 1.

Upon receiving a signal from the process control means 11, the scanner driver circuit 12 operates to cause the selection of one sorting channel among a plurality of the sorting channels and the simultaneous connection of the respective contacts, each associated with the selected channel, within the first–fourth switching circuits 13–16 to their respective output or input terminals. Because all the sorting channels have the same construction as already described, the explanation made hereunder is on the assumption that the scanner circuit means selects the second sorting channel Q2. As a result, the respective input terminals 2, 2 of the first and second switching circuits 13 and 14 are internally connected to their output terminals, and the respective output terminals 2, 2 of the third and fourth switching circuits 15 and 16 are internally connected to their input terminals, respectively. Subsequently, the process control means 11 sends out a signal to the feeder V2 through the third switching circuit 15 so as to reduce the amount of grains flowing down to the sorting area until the number of output pulses (H) within a predetermined period of time input from the ejector driver circuit E2 through the first switching circuit 13 becomes less than a reference number within the above period of time (for example, 7–10 times/second). If the number of pulses (H) is less than the above reference number, the process control means 11 takes in a signal which is one produced by having the output of the second switching circuit 14 from the main amplifier B2 firstly amplified by the amplifier 17, having the amplified signal then rectified and smoothed by the wave processing circuit 18 and having the processed signal finally converted into a digital signal by the A/D converter 19. The process control means 11 then compares the signal with reference voltage Y (refer to FIG. 2) to determine whether the brightness of the background is too bright. Under this circumstance, if the level of the signal is in excess of the reference voltage Y, the process control means 11 causes the light control device P2 to operate through the fourth switching circuit 16 so as to reduce the supply voltage for the light source lamp L2, thereby reducing the amount of light.

When the level of the signal from the A/D converter 19 becomes less than the reference voltage Y as a consequence of the reduction of the amount of light, the process control means 11 then operates to determine whether the brightness of the background is too dark or not, that is, whether the level of the signal from the A/D converter 19 is less than the reference voltage Z or not. If it is less than the reference voltage Z, the process control means 11 operates to control the light control device P2 in such a manner as described above, so as to raise the voltage for the light source lamp L2. The outputs of the fourth switching circuit 16 are also input to the display devices G1–Gn as described before and, thus, while the light control devices P1–Pn are operating, the display devices G1–Gn also operate to indicate the sorting channels for which the control of the amount of light is being carried out. In the example where the second sorting channel Q2 is the subject of the light control, the display device G2 indicates this sorting channel Q2.

An audible alarm device may also be employed, if desired or necessary, in addition to the provision of the display devices G1–Gn. An operator can, therefore, check whether the light source lamp is out of order or whether the automatic control of the amount of light is being carried out with respect to the indicated sorting channel (in the above case Q2) and he can reset the display devices by pressing the reset button R.

In accordance with the progress of the controlling of the brightness of the background as state above, that is, in the case where the output signal from the A/D converter 19 reaches the range between the reference voltages Z and Y, the process control means 11 again sends out a signal to the feeder V2 through the third switching circuit 15 so as to increase the amount of flowing grains until the number of times (H) the ejector operates reaches 30–50 times per second, and if the number of times (H) reaches the above range, the process control means 11 operates to send out another signal to the scanner driver circuit 12 so as to make the position of the contacts of the first to fourth switching circuits 13–16 change to the next position. In this case, the internal-connections in the respective switching circuits 13–16 are changed from the second to the third stationary contacts, and therefore, the procedure of the automatic control of the background brightness with respect to the sorting channel Q3 in place of the channel Q2 begins from this moment. Thus, all the sorting channels Q1–Qn can have the brightness of their backgrounds controlled one by one in a successive manner.

It should be noted that, throughout this specification, the wording or phrase "the background brightness or the brightness of the background" is used to mean the amount of light as detected by the sensor and not the actual brightness of the background itself.

The device hereinabove described is embodied in a colour sorting apparatus which has a plurality of sorting channels. However, it should be noted that the feature of the present invention may be successfully utilized in a colour sorting apparatus having one sorting channel, in which case a scanner circuit means is not used.

As has been explained hereinabove, the colour sorting apparatus incorporating the device of the present invention offers an advantageous effect in that the brightness of the backgrounds can be automatically controlled even if the backgrounds become dusty or there occur fluctuations in the brightness of the backgrounds, thereby ensuring the desired uniform sorting performance.

Furthermore, an arrangement may be made so that, while the brightness of the background is being automatically controlled, the sorting channel under adjustment is both indicated and alarmed. This will enable an operator to learn the conditions with respect to the backgrounds externally of the apparatus.

While the invention has been described in its preferred embodiment, it is to be distinctly understood that the invention is not limited thereto but may be otherwise variously modified within the scope of the following claims.

What is claimed is:

1. An automatic background brightness control device for colour sorting apparatus having a plurality of sorting channels, each of said channels comprising a sensor, an ejector driver circuit and a feeder, said sensor being adapted to detect the amount of reflected and/or transmitted light from objects to be sorted and the amount of reflected and/or transmitted light from a background provided at the sorting channel, said device comprising:

a process control means comprising a means for comparing the number of pulses sent from said ejector driver circuit within a predetermined period of time against predetermined reference numbers representative of a decreased grain flow and a normal grain flow and producing feeder control signals for decreasing and increasing the grain flow from said feeder as a result of said comparison to said predetermined reference numbers, respectively, means for comparing outputs from said sensor against predetermined reference voltages while the grain flow is decreased responsive to said feeder control signals and producing a background brightness control signal only when said output from said sensor deviates from said reference voltages, and means for producing a selection signal while the grain flow is normal;

a scanner circuit means for selecting, in response to the selection signal from said process control means, from said sorting channels the sorting channel of which the background brightness is to be controlled, said scanner circuit means selecting said sorting channels one after another so that the control of the background brightness of one sorting channel begins upon the completeion of the control of the background brightness of the previous channel; and a light control means for controlling the background brightness within said selected sorting channel according to said background brightness control signal.

2. An automatic background brightness control device according to claim 1, in which said light control means comprises a plurality of light control devices and said scanner circuit means comprises:

a first switching circuit for selecting one of said ejector driver circuits to be connected to said process control means;

a second switching circuit for selecting one of said sensors to be connected to said process control means;

a third switching circuit for selecting one of said feeders to be connected to said process control means;

a fourth switching circuit for selecting one of said light control devices to be connected to said process control means; and a scanner driver circuit for making the positions of the contacts of said first to fourth switching circuits change respectively to the next position according to the selection signal.

3. An automatic background brightness control device according to claim 1, in which said process control means receives said signal from said sensor in the form of a digital signal from a series circuit comprising an amplifier, a wave processing circuit and an A/D converter.

4. An automatic background brightness control device according to claim 1, in which said device further comprises an indicator means for indicating the sorting channel for which the control of the background brightness is being carried out when said light control means is operating.

5. An automatic background brightness control device according to claim 4, in which said indicator means comprises a plurality of display devices.

6. An automatic background brightness control device according to claim 4, in which said indicator means further comprises an alarm device for alarming in an audible manner.

* * * * *